US009557046B2

(12) United States Patent
Sun et al.

(10) Patent No.: US 9,557,046 B2
(45) Date of Patent: Jan. 31, 2017

(54) LED LAMP AND METHOD OF MAKING THE SAME

(71) Applicant: EPISTAR CORPORATION, Hsinchu (TW)

(72) Inventors: Chih-Hsuan Sun, Kaohsiung (TW); Wei-Yu Yeh, Tainan (TW); Tien-Ming Lin, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 13/858,779

(22) Filed: Apr. 8, 2013

(65) Prior Publication Data

US 2013/0314915 A1 Nov. 28, 2013

Related U.S. Application Data

(63) Continuation of application No. 13/158,962, filed on Jun. 13, 2011, now Pat. No. 8,414,160.

(51) Int. Cl.
*F21V 29/00* (2015.01)
*F21K 99/00* (2016.01)
(Continued)

(52) U.S. Cl.
CPC ..... *F21V 29/2206* (2013.01); *F21K 9/232* (2016.08); *F21K 9/90* (2013.01); *F21V 29/74* (2015.01);
(Continued)

(58) Field of Classification Search
CPC ..... F21V 29/004; F21V 29/02; F21V 29/10; F21V 29/70; F21V 29/74; F21V 29/745; F21V 29/77; F21V 29/773; F21V 29/777; F21V 29/78
(Continued)

(56) References Cited

U.S. PATENT DOCUMENTS 7,434,964 B1 * 10/2008 Zheng ..... F21V 29/006 362/218
7,513,653 B1 * 4/2009 Liu ..... F21V 29/004 362/218
(Continued)

OTHER PUBLICATIONS

Ningbo Ledel Lighting Co., Ltd., website, LED lamp and bulb product catalog printed from www.ledelamp.com on May 29, 2011, 2 pages.

*Primary Examiner* — Bryon T Gyllstrom
(74) *Attorney, Agent, or Firm* — Muncy, Geissler, Olds & Lowe, P.C.

(57) ABSTRACT

A lighting device includes a multi-faceted heat sink with facets in a center portion facing outward. The facets form a central enclosed portion, and the heat sink further has a plurality of fins, where each of the fins is placed between adjacent facets and protrudes outwardly from the heat sink. The lighting device also has a plurality of circuit boards with semiconductor emitters mounted thereon. Each of the circuit boards is mounted on a respective facet of the heat sink. The lighting device also has a light-diffusion housing covering the plurality of circuit boards, a power module in communication with the circuit boards and operable to convert power to be compatible with the semiconductor emitters, and a power connector assembly in electrical communication with the power module.

20 Claims, 15 Drawing Sheets

(51) Int. Cl.
*F21V 29/74* (2015.01)
*F21V 3/02* (2006.01)
*F21Y 101/00* (2016.01)

(52) U.S. Cl.
CPC ..... *F21V 3/02* (2013.01); *F21Y 2101/00* (2013.01); *Y10T 29/49002* (2015.01)

(58) Field of Classification Search
USPC ..... 362/294, 373, 235, 249.02
See application file for complete search history.

(56) References Cited

U.S. PATENT DOCUMENTS 7,637,636 B2 * 12/2009 Zheng et al. ..... 362/294
7,690,813 B2 * 4/2010 Kanamori et al. ..... 362/249.02
7,695,162 B2 * 4/2010 Zhang ..... F21S 6/00 362/294
7,726,836 B2 * 6/2010 Chen ..... 362/249.02
7,748,876 B2 * 7/2010 Zhang ..... F21K 9/00 165/104.33
7,810,968 B1 * 10/2010 Walker et al. ..... 362/431
7,862,210 B2 * 1/2011 Zhang ..... F21V 15/01 362/249.02
8,167,466 B2 5/2012 Liu
8,227,968 B2 7/2012 Kaandorp et al.
8,237,339 B2 8/2012 Chen et al.
8,240,889 B2 8/2012 Gong et al.
8,299,693 B2 10/2012 Chen
8,322,892 B2 12/2012 Scordino et al.
8,322,896 B2 12/2012 Falicoff et al.
8,371,722 B2 * 2/2013 Carroll ..... F21K 9/135 362/235
8,653,723 B2 * 2/2014 Cao et al. ..... 313/46
2007/0159828 A1 * 7/2007 Wang ..... F21V 3/00 362/294
2007/0285930 A1 * 12/2007 Chen ..... F21V 19/0045 362/373
2008/0013318 A1 * 1/2008 Sun et al. ..... 362/294
2008/0062703 A1 * 3/2008 Cao ..... 362/311
2009/0185379 A1 * 7/2009 Chen ..... 362/294
2010/0073944 A1 * 3/2010 Chen ..... 362/373
2010/0264799 A1 10/2010 Liu et al.
2011/0089838 A1 4/2011 Pickard et al.
2011/0156584 A1 * 6/2011 Kim ..... F21K 9/00 315/32
2013/0094199 A1 * 4/2013 Lin et al. ..... 362/218

* cited by examiner

LED LAMP AND METHOD OF MAKING THE SAME

PRIORITY DATA

This application is a continuation application of U.S. patent application Ser. No. 13/158,962, filed on Jun. 13, 2011, entitled "LED LAMP AND METHOD OF MAKING THE SAME", the disclosure of which is hereby incorporated by reference in its entirety.

BACKGROUND

The semiconductor integrated circuit (IC) industry has experienced rapid growth in recent years. Technological advances in IC materials and design have produced various types of ICs that serve different purposes. One type of these ICs includes photonic devices, such as light-emitting diode (LED) devices. LED devices emit light through movement of electrons in a semiconductor material when a voltage is applied. LED devices have increasingly gained popularity due to favorable characteristics such as small device size, long life time, efficient energy consumption, and good durability and reliability.

A-lamps have been in use for over a century as the most commonly seen incandescent lamps. In the United States, a typical household has many A-lamps with the familiar bulb shape in use in overhead fixtures, table lamps, and the like.

Recent developments have led to a phasing out of incandescent lamps in some parts of the world. One candidate for replacing incandescent lamps is lamps based on Light-Emitting Diodes (LEDs). LEDs produce more light for the same amount of power compared to incandescent lamps.

There have been attempts at making LED-based A-lamps, but many are unsatisfactory. Traditionally, LED-based A-lamps produce forward lighting patterns because of the directive characteristics of LEDs. In some instances, forward light can be so bright that makes human eyes feel uncomfortable. Also, depending on how a luminaire of a directive A-lamp is installed, the A-lamp may radiate light in an undesirable or useless direction.

LEDs produce heat when radiating light. Thus, heat sinks are used for LED lighting luminaires in some conventional systems. It is typically easier to provide thermal management for a highly-directive luminaire that produces light from a single plane than it is to provide thermal management for a luminaire that attempts to approximate a uniform sphere of light. That is because some conventional LED A-lamps that attempt a spherical lighting pattern trap heat in the middle of the structure. Thus, in many designs, a desirable light pattern may be balanced with competing thermal management concerns. While some conventional LED lamps may be satisfactory in some aspects, LED lamps can use improvement.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

SUMMARY

Figure 1:
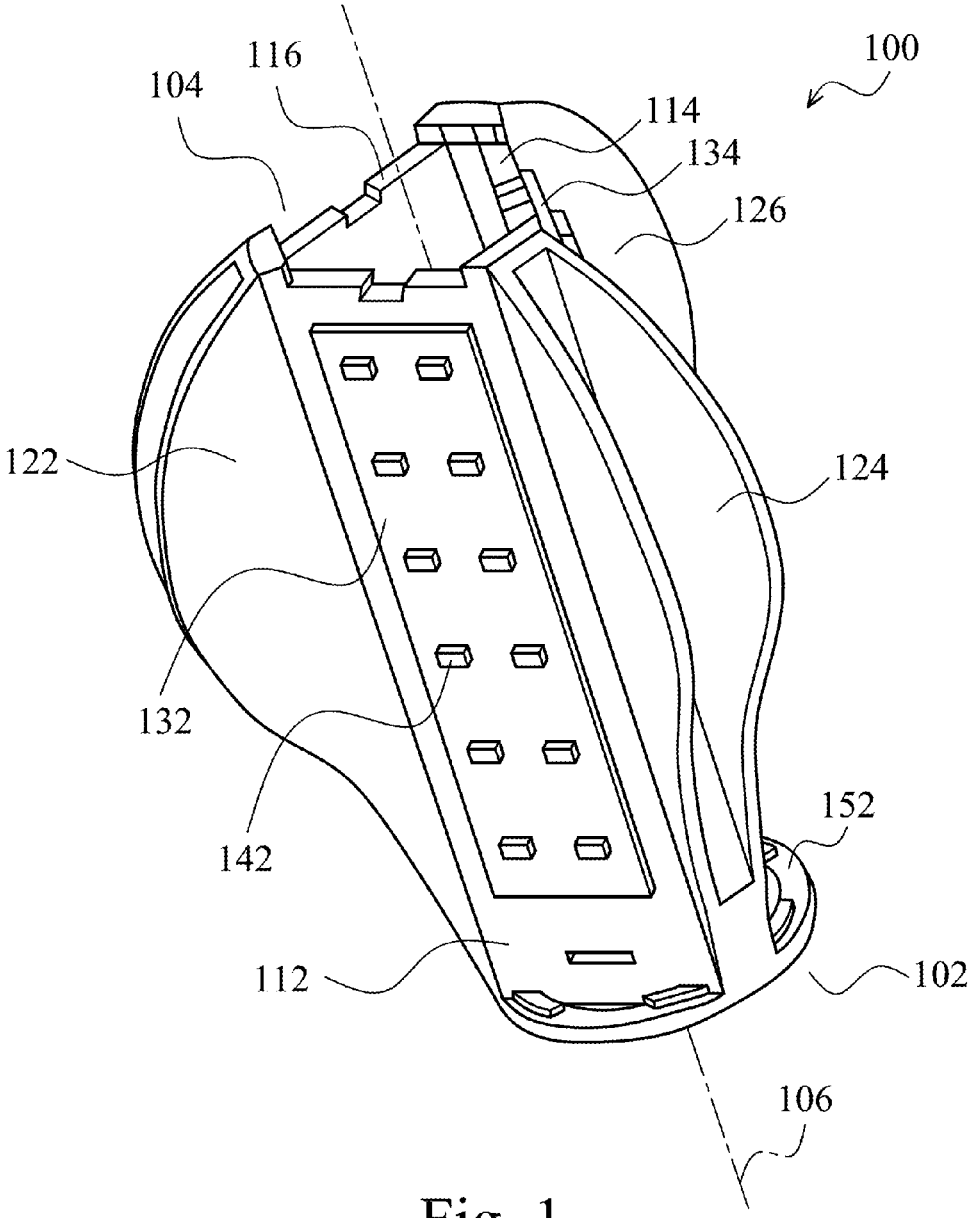
FIGS. 1, 5, and 7-10 are perspective views of an example LED lamp, showing a progression of an exemplary process for manufacturing such LED lamps in accordance with various aspects of the present disclosure.

One of the broader forms of the present disclosure involves a lighting device that includes a multi-faceted heat sink with facets in a center portion facing outward. The facets form a central enclosed portion, and the heat sink further has a plurality of fins, where each of the fins is placed between adjacent facets and protrudes outwardly from the heat sink. The lighting device also has a plurality of circuit boards with semiconductor emitters mounted thereon. Each of the circuit boards is mounted on a respective facet of the heat sink. The lighting device also has a light-diffusion housing covering the plurality of circuit boards, a power module in communication with the circuit boards and operable to convert power to be compatible with the semiconductor emitters, and a power connector assembly in electrical communication with the power module.

Another one of the broader forms of the present disclosure involves a lamp that has a heat sink with a plurality of fins and facets, where the facets are arranged around a central axis and face outwardly from the central axis and each of the fins is placed between adjacent ones of the facets and extends outwardly from the central axis. The lamp also has a plurality of circuit boards, where each one of the circuit boards is mounted on a respective facet, and each one of the circuit boards includes an array of semiconductor emitters thereon. The lamp further has a light diffusing housing covering each of the facets and exposing the fins, a power conversion module in communication with the semiconductor emitters, and a power connector in communication with the power conversion module.

Still another one of the broader forms of the present disclosure involves a method for making a lamp that includes providing a heat sink, where the heat sink has a plurality of fins and facets, and the facets are arranged around a central axis and face outwardly from the central axis, and each of the fins is placed between adjacent ones of the facets and extends outwardly from the central axis. The method further includes disposing a plurality of circuit boards on the plurality of facets, where each of the circuit boards has an array of semiconductor emitters, electrically connecting the semiconductor emitters to a power conversion device, enclosing the facets with a light diffusing housing, and coupling a power connector to the heat sink and electrically connecting the power connector to the power conversion device.

DETAILED DESCRIPTION

It is to be understood that the following disclosure provides many different embodiments, or examples, for implementing different features of the invention. Specific examples of components and arrangements are described below to simplify the present disclosure. These are, of course, merely examples and are not intended to be limiting. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Various features may be arbitrarily drawn in different scales for the sake of simplicity and clarity.

Various embodiments include lamps made with Light-Emitting Diodes (LEDs) that have improved light patterns as well as favorable thermal management properties. In one example, the lamp conforms to a familiar A-lamp shape with an Edison Screw power connector. Such embodiment may be retrofitted into existing light fixtures the same way that incandescent A-lamps are currently used.

In an example embodiment, a manufacturing process begins with a thermal heat sink. The heat sink is shaped to accommodate arrays of LEDs in a configuration that produces a nearly uniform light pattern. In this example, the heat sink is made of a thermally conductive material, as described in more detail below. The particular shape of the heat sink is designed to provide a framework for a familiar light bulb shape while at the same time spreading heat away from the LEDs and radiating as much heat as possible to the ambient atmosphere.

To accomplish the heat management task while providing a pleasing light pattern, the heat sink has a plurality of facets, each with a length dimension paralleled to the length dimension of the lamp itself. The facets are central to the light bulb form factor and face outwardly therefrom, creating a semi-enclosed space in the center of the lamp with openings at the top and at the bottom.

To enhance heat transfer, the heat sink has fins. Each of the fins is placed between two adjacent facets and protrudes outwardly from the central axis of the lamp. The fins have substantial surface area exposed to ambient atmosphere, thereby facilitating heat transfer from the center of the lamp to the air.

LEDs may be mounted to each of the facets. In one example, the LEDs are mounted to the facets using heat spreading circuit boards. As a virtue of the arrangement of the facets, each of the LED circuit boards faces outwardly from the central axis of the lamp, and while each of the LEDs may provide a directional pattern, the collective effect of the numerous LEDs facing outwardly through a light diffusing housing produces a substantially uniform light pattern for the human eye.

Additional features include, among other things, a light-diffusing housing and power conversion unit. The various components and advantages of example embodiments are described in more detail below. While the embodiments described below are shown as conforming to a typical light bulb shape with a narrow bottom at the power connector and a wider top, the scope of embodiments is not so limited. Various embodiments may deviate from the typical light bulb shape and may also have power connectors different from the familiar Edison Screw, such as a bi-pin connector.

FIGS. 1, 5 and 7-10 illustrate an exemplary process for manufacturing a lamp according to one embodiment. The process is illustrated as perspective views of the lamp in various states of assembly.

FIG. 1 is a perspective view of exemplary heat sink 100. Heat sink 100 has base 102 and top 104. For ease of illustration, the following description refers to central axis 106, which in this example is an imaginary line through the middle of heat sink 100 and corresponding to the greatest dimension of heat sink 100 (also referred to herein as the length dimension).

Heat sink 100 has three facets 112, 114, and 116. In FIG. 1 only facet 112 is facing the viewer, and it is understood that facets 114, 116 are substantially the same as facet 112. Each of facets 112, 114, 116 faces outwardly from center axis 106. Further, each of the facets 112, 114, 116 is substantially flat and rectangular, occupying its own plane in three-dimensional space. In a top-down view shown in FIG. 2, facets 112, 114, 116 together approximate an equilateral triangle and define semi-enclosed space 202. Facets 112, 114, 116 are shown in FIG. 2 facing outwardly, with arrows indicating the direction of propagation of light as it is emitted from each of the facets 112, 114, 116.

Heat sink 100 also has three heat spreading fin structures 122, 124, 126 (referred to herein as "fins"). Fins 122, 124, 126 substantially increase the surface area of heat sink 100, thereby substantially increasing the interaction between the material of the heat sink 100 and molecules of ambient air. In this example, as exposed surface area increases, heat dissipation increases as well. The shape and orientation of Fins 122, 124, 126 provides a novel way of increasing heat sink surface area in the LED lamp without unduly obstructing emitted light.

Figure 2:
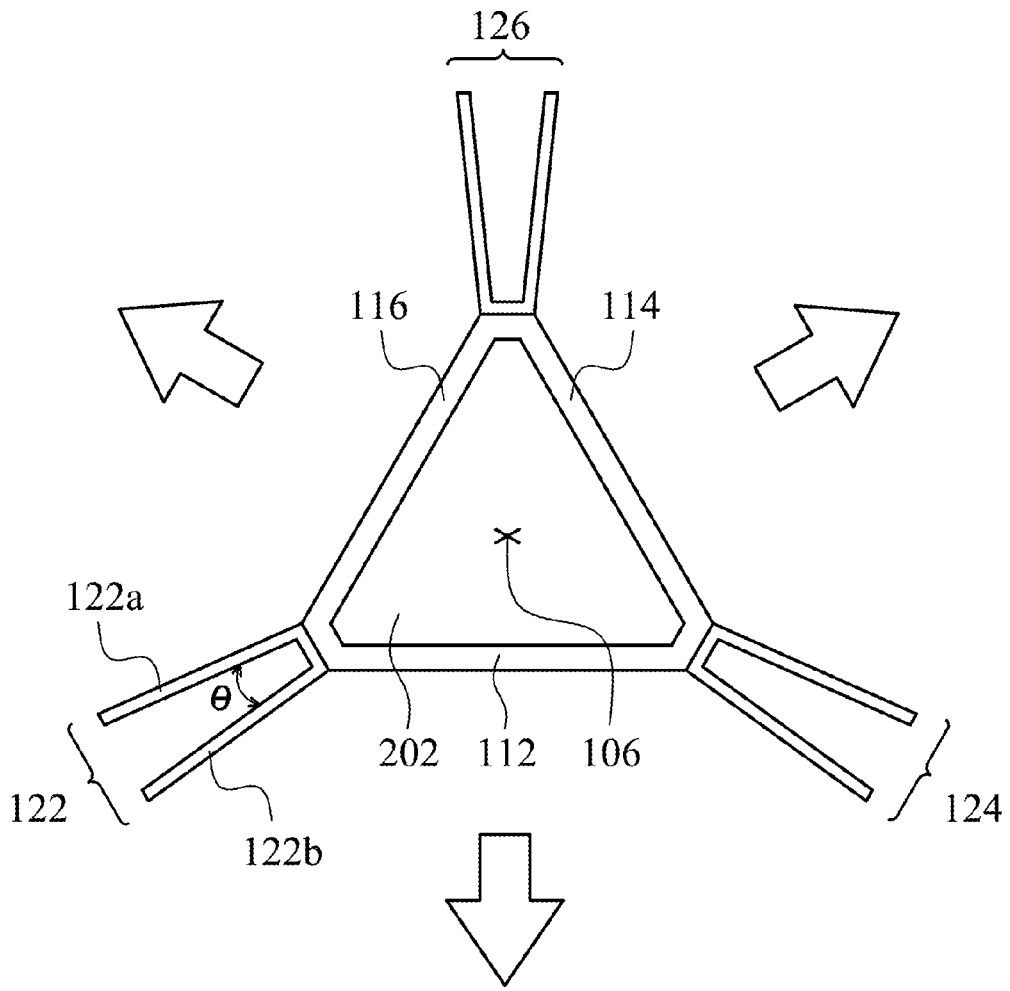
FIG. 2 is a top-down view of an exemplary heat sink in accordance with various aspects of the present disclosure.

Further in the example of FIGS. 1 and 2, each of fins 122, 124, 126 has a double-fin structure to increase the amount of surface area for each fin. Using fin 122 as an example, fin sub-structures 122*a*, 122*b* protrude outward at a slight relative angle theta. The space between sub-structures 122*a*, 122*b* provides for airflow and contact with ambient air. The angle theta can vary in different embodiments, and is selected in the example of FIGS. 1 and 2 to provide enough space between sub-structures 122*a*, 122*b* to allow some amount of airflow so that heat is dissipated rather than trapped between sub-structures 122*a*, 122*b*.

Fins 122, 124, 126 are shown as their own separate structures, and facets 112, 114, 116 are shown as making a separate structure as well (referred to herein as the "facet structure"). Fins 122, 124, 126 can be coupled to the facet structure using any available technique, such as fasteners, thermally conductive adhesive, and the like. Alternatively, heat sink 100 may be a one-piece structure, with facets 112, 114, 116 and fins 122, 124, 126 formed together as a single piece. The scope of embodiments is not limited to any particular technique for manufacture or assembly of heat sink 100.

Figure 3:
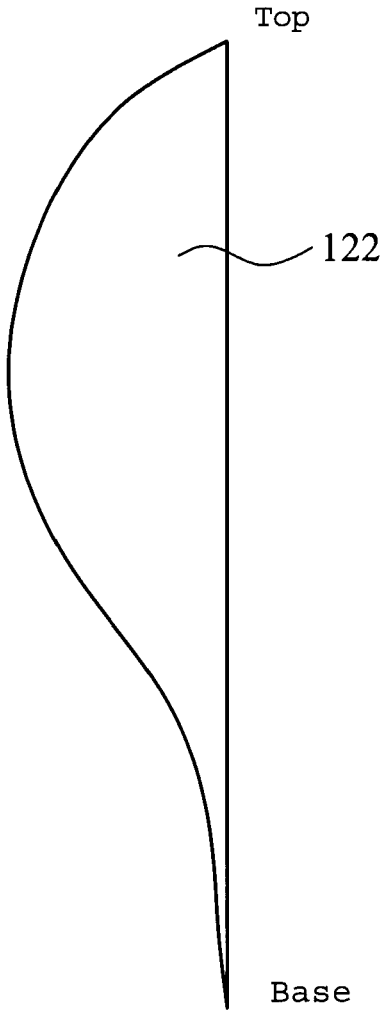
FIG. 3 is a side-view of an exemplary fin in accordance with various aspects of the present disclosure.

Fins 122, 124, 126 have a profile as shown in FIG. 3, exemplified by fin 122. FIG. 3 is a profile of fin 122, showing fin 122 by itself. Fin 122 is narrow near the base of the lamp and increases in thickness toward its middle. At the top, the profile of fin 122 narrows again but less gradually than at the base. When included in heat sink 100, the profile of fin 122 provides a familiar light bulb shape to the lamp. Specifically, many conventional light bulbs are more narrow at the base and have a quasi-spherical top portion. The profile of fin 122 conforms to this shape, allowing the lamp to have a A-lamp shape that is recognizable to consumers and invites consumers to retrofit the LED lamp into sockets originally used for incandescent A-lamps.

While the profile of fin 122 is shown as conforming to an A-lamp shape, the scope of embodiments is not so limited. Other embodiments may include lamps conforming to other shapes, such as candle (B), bent tip candle (CA and BA), flame (F), fancy round (P), globe (G), and the like. The shape of fins 122, 124, 126 can be designed to provide thermal management while conforming to the overall shape of the lamp for any given lamp shape.

Heat sink 100 (including fins 122, 124, 126) may be constructed of any suitable material or combination of materials. Examples of suitable materials include, but are not limited to, aluminum, copper, iron, and the like. Fins 122, 124, 126 may be constructed of the same or a different material than that used for facets 112, 114, 116.

Returning to FIG. 1, circuit board 132 is disposed on facet 112. Similarly, circuit board 134 is disposed upon facet 114, though only a small portion is shown in FIG. 1. It is understood that circuit board 134 is substantially similar to circuit board 132, and it is also understood that facet 116 also has a circuit board (not shown) substantially similar to circuit board 132. The description of circuit board 132 applies to such other circuit boards as well.

Circuit board 132 may be a Metal Core Printed Circuit Board (MCPCB), ceramic board $Al_2O_3$ ceramic board AlN, direct type Cu board. In this example the circuit board 132 is MCPCB. MCPCBs can conform to a multitude of designs, but the description herein refers to a simple single-layer MCPCB for ease of illustration. An example MCPCB for use with heat sink 100 includes a PCB where the base material for the PCB includes a metal, such as aluminum, copper, a copper alloy, and/or the like. A thermally conductive dielectric layer is disposed upon the base metal layer to electrically isolate the circuitry on the printed circuit board from the base metal layer below. The circuitry and its related traces can be disposed upon the thermally conductive dielectric material. In this example, the circuitry includes arrays of LEDs. Circuit board 132 has twelve LEDs, exemplified by LED 142.

During normal operation, LED 142, and the other LEDs as well, produce heat and light. Heat buildup can damage LED 142 and/or reduce the light output over time for LED 142. A MCPCB can effectively remove heat from LED. Specifically, in one example, the heat from LED 142 is transferred by the thermally conductive dielectric material to the metal base. The metal base then transfers the heat to heat sink 100, which dissipates heat into the ambient atmosphere. In other words, the thermally conductive dielectric layer and the metal base act as a heat bridge to carry heat efficiently and effectively from the LEDs to heat sink 100.

In some examples, the metal base is directly in contact with heat sink 100, whereas in other examples a material intermediate heat sink 100 and circuit board 132 is used. Intermediate materials can include, e.g., double-sided thermal tape, thermal glue, thermal grease, and the like.

Various embodiments can be adapted to use other types of MCPCBs. For instance, some MCPCBs include more than one trace layer, and such MCPCBs can be used when convenient.

Figure 4:
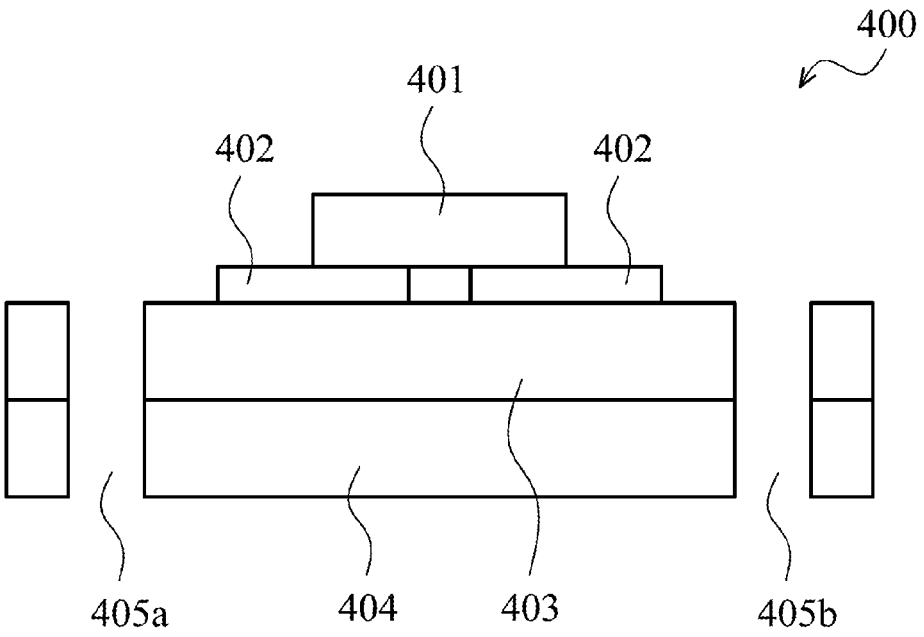
FIG. 4 is an illustration of an exemplary circuit board in accordance with various aspects of the present disclosure.

FIG. 4 is an illustration of exemplary single-layer MCPCB 400 in a cross-section with LED 401 mounted thereon. MCPCB 400 includes metal base 404, which may include, e.g., aluminum, copper, or a copper alloy. Thermally conductive dielectric layer 403 is included on metal base 404. An example material for layer 403 includes a thermally conductive prepreg.

Copper traces 402 are made on layer 403 using conventional techniques for PCB manufacture. LED 401 is then mounted on MCPCB 400 using, e.g., solder. MCPCB 400 also includes mounting holes 405*a*, 405*b*. In one example, screws can be used to fasten MCPCB 400 to a heat sink. MCPCB 400 provides an illustration of an example use of a circuit board. Circuit board 132 (FIG. 1) can be manufactured to include similar materials and can be employed similarly in use on heat sink 100 and may include multiple metal layers.

Circuit boards, such as circuit board 132, may be made of materials other than those mentioned above. In fact, any suitable material may be used, even materials with less thermal conductivity than those used in MCPCBs. For instance, other embodiments may employ circuit boards made of FR-4, ceramic, and the like.

The LEDs exemplified by LED 142 are shown as surface mounted LEDs. In one example, the surface mounted LEDs are soldered to pads (not shown) on circuit board 132 to provide power. However, other embodiments may include LEDs with wire leads.

Various embodiments may employ any type of LED appropriate for the application. For instance, conventional LEDs may be used, as well as Organic LEDs (OLEDs), Polymer LEDs (PLEDs), and the like. Various embodiments may find special utility in higher-output power LEDs to ensure light output similar to that expected of an incandescent bulb.

Furthermore, various embodiments may include technical features to ensure that light of a desired color is radiated from the lamp. Quantum well structures inside each LED affect the wavelength of the light emitted. The properties of the quantum well structure can be designed to produce light of a desired wavelength. However, many consumers prefer white light, and various embodiments may use one or more techniques to produce white light from individual LEDs that would otherwise produce non-white (e.g., blue) light.

In one example, LEDs of different wavelengths are placed close together. In aggregate, during normal operation, the light produced appears white to the human eye. An advantage of such feature is that the aggregate color of the light can be tuned by individually adjusting the power of the differently-colored LEDs. A disadvantage of such technique is that it may be more difficult to produce light that appears uniform to a human user.

In another example, phosphor is used to convert a first wavelength of light to a broader spectrum of white light. A disadvantage of such feature is that some light energy is converted to heat and lost during the phosphor color conversion, though uniformity of color may be desirably provided. The scope of embodiments is not limited to any particular type of LED, nor is it limited to any particular color scheme.

Moreover, circuit board 132 is shown with an array of twelve LEDs in FIG. 1, where each facet 112, 114, 116 has its own similar array, for a total of thirty-six LEDs. The scope of embodiments includes any number of LEDs to make a lamp that has desirable light output properties, including both luminosity and color. For instance, a 60 W incandescent light bulb may be expected to have an output of around 850 lumens at a nearly white color spectrum. Various embodiments may be designed to have similar properties, but with the power savings of an LED device. However, the scope of embodiments includes lamps with any desirable luminosity or color.

Heat sink 100 includes other features that help to adapt it for use in an A-lamp device. Base 102 includes circular flange 152. As described in more detail below, circular flange 152 accommodates a round power connector fitting at base 102. Also, top 104 is shaped to fit a cap that conforms to the quasi-spherical shape of a top of an A-lamp. Also, both top 104 and base 102 are open in FIG. 1, so that facets 112, 114, 116 do not entirely enclose space 102.

Figure 5:
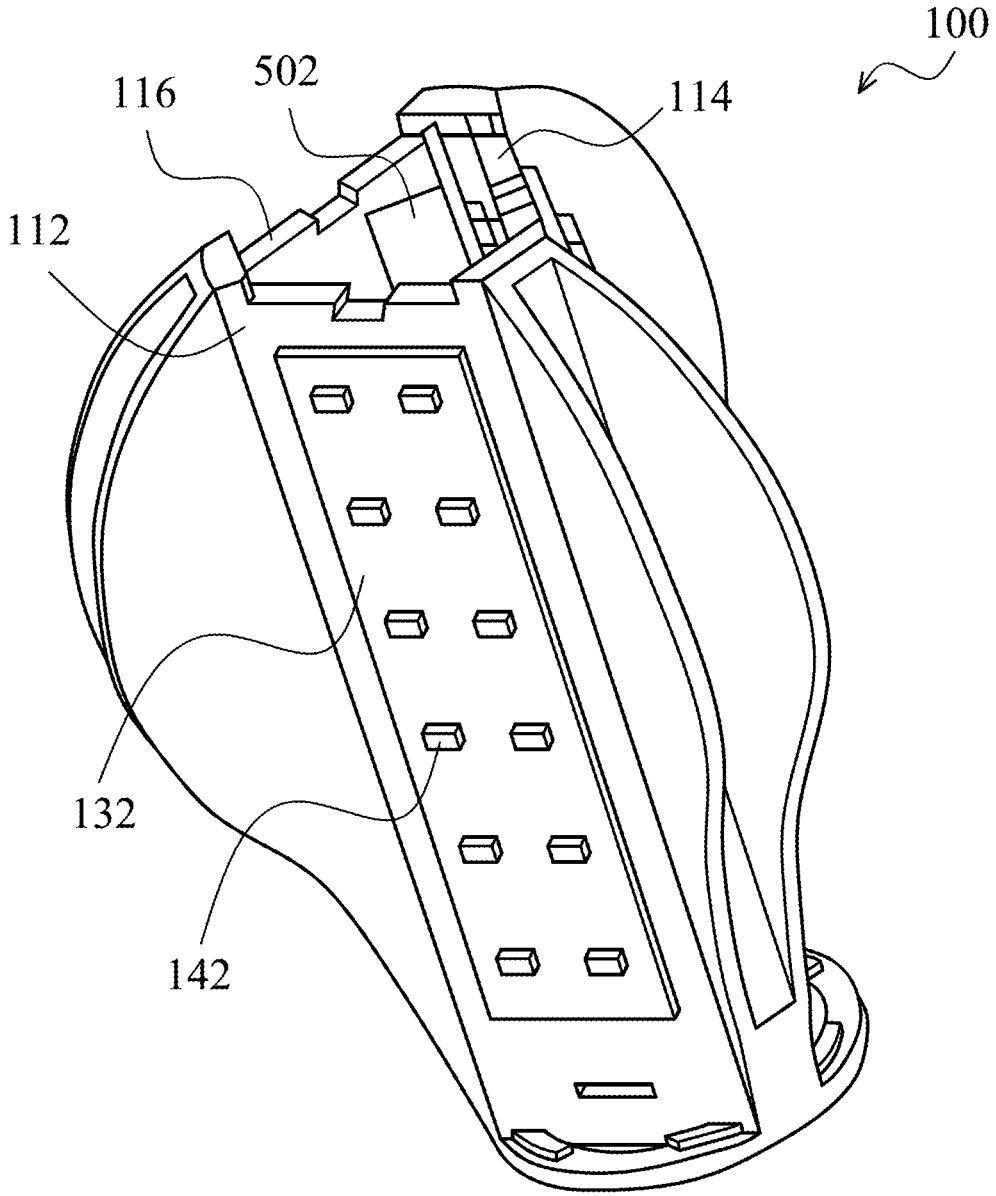

Moving to FIG. 5, heat sink 100 is shown in perspective but with the addition of power conversion module 502. Electrical power is typically provided to indoor lighting at 120V/60 Hz in the US, and over 200V and 50 Hz in much of Europe and Asia, and incandescent lamps typically apply that power directly to the filament in the bulb. However, LEDs use power conversion devices to change the power from the typical indoor voltages/frequencies to power that is compatible with LEDs.

In one example, power conversion device 502 receives 50 Hz or 60 Hz Alternating Current (AC) power and converts the power to a suitable Direct Current (DC) current and voltage. The voltage versus current properties of an LED are usually like that of a typical diode, where current is an approximately exponential function of voltage. Thus, a small change in voltage can lead to a larger change in current. If a voltage is below the particular threshold of an LED, the LED will remain in an off state and emit no light. On the other hand, if a voltage is too high, the current may exceed recommended levels and damage or destroy the LED. Thus, in some embodiments, power conversion device 502 includes a constant current regulator to apply DC power at a regulated, safe current. In one example, power conversion device 502 may output power at hundreds or tens of milliamps and around thirty six volts. However, the scope of embodiments is not limited to any particular power output to the arrays of LEDs. Various embodiments may apply any desirable type of power to the LED arrays to achieve any desired lighting effect. In some embodiments, power conversion module 502 may modulate current and/or duty cycle to vary a color and/or luminosity of an LED array.

Figure 6:
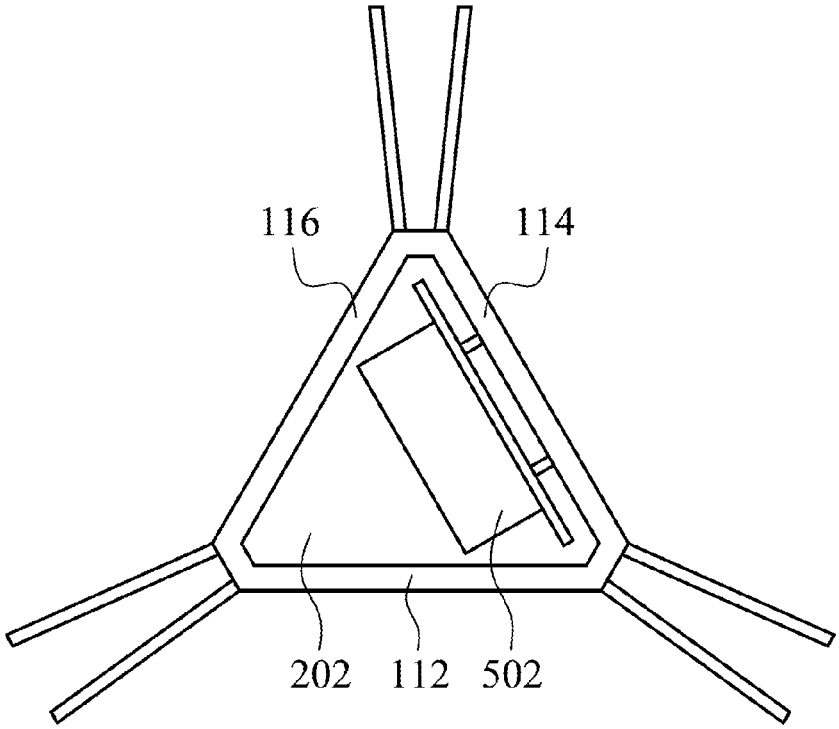
FIG. 6 is a top-down view of an exemplary heat sink and power conversion module in accordance with various aspects of the present disclosure.

FIG. 6 is a top-down view of heat sink 100 with power module 502 installed therein. Power module 502 is installed on the back of facet 114 and can be installed using any appropriate technique, e.g., adhesive, screws, mounting bracket, and/or the like. In the present example, power conversion module 502 is mounted such that there is a space between power module 502 and the back of facet 114. Such arrangement protects power conversion module from the heat produced by the LED array on facet 114 and vice versa. In alternative embodiments, power conversion module 502 may be mounted directly against the back side of facet 114.

Furthermore, while FIGS. 5 and 6 show power conversion module mounted behind facet 114, other embodiments may mount power conversion module in any orientation within semi-enclosed space 202. For instance, other embodiments may mount power conversion module 502 closer to the central axis 106 than to any particular facet 112, 114, 116 or may mount power conversion module directly behind facet 112 or 116. In other embodiments, semi-enclosed space 202 may be filled with an electrically isolating gel that surrounds power conversion module 502.

Moreover, power conversion module 502 is in electrical contact with each of the arrays of LEDs on facets 112, 114, 116. FIGS. 5 and 6 omit showing the physical electrical connections for simplicity, but it is understood that various embodiments may use, e.g., soldered wires to provide electrical contact between power conversion module 502 and the arrays of LEDs. The arrays of LEDs may be configured in any appropriate way including, but not limited to, in series, in parallel, or a combination thereof.

Figure 7:
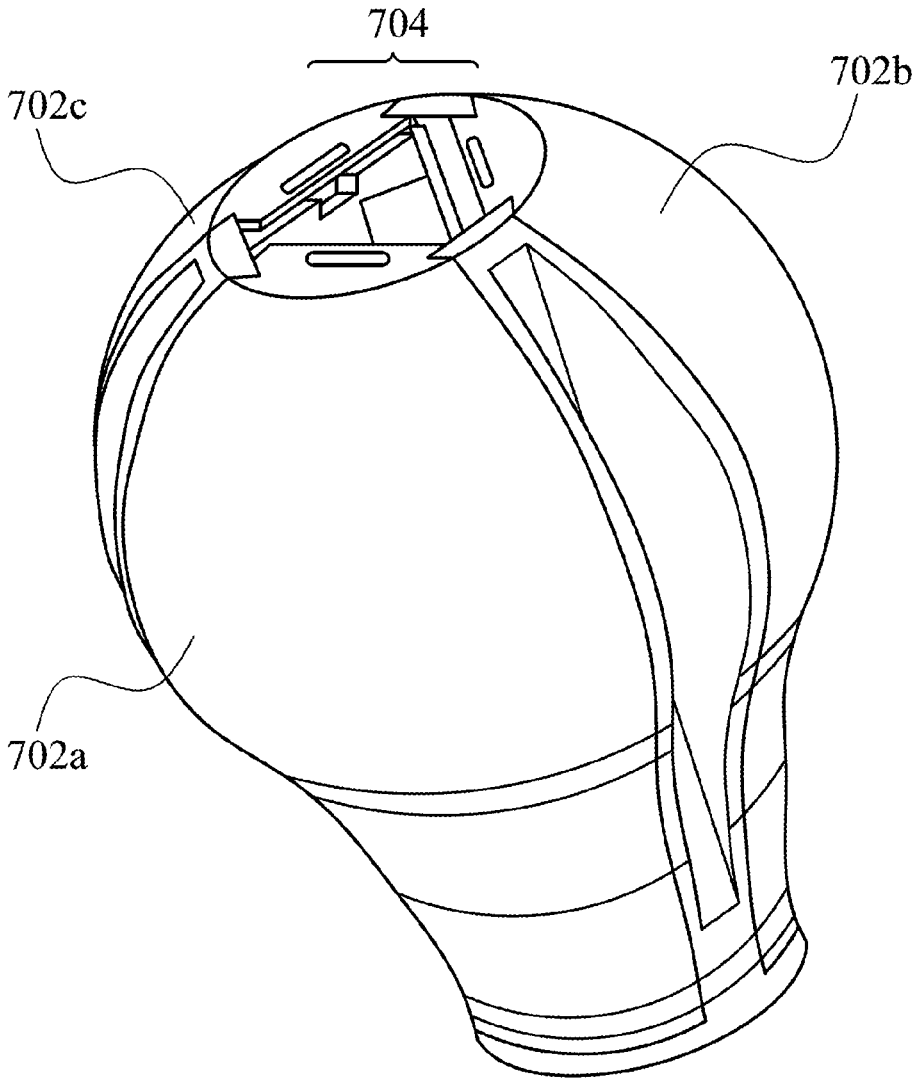

At FIG. 7, diffuser cap 702 is installed on heat sink 100. The light produced by the LED arrays on facets 112, 114, 116 can be somewhat directional and uncomfortable to look at directly. Diffuser cap 702 diffuses the light emitted from the LED arrays to make the light pattern more uniform and less directional and appear more soft to the human eye.

In one example, diffuser cap 702 is constructed of polycarbonate (PC) plastic that has a diffusive particles added to it and/or has numerous, small irregularities in the plastic to the emitted light. Other embodiments may use other materials to construct diffuser cap 702, such as polymethyl methacrylate (PMMA) plastic, glass, and the like. Diffuser cap 702 may also be colored to act as a color filter in some embodiments.

Diffuser cap 702 is shown including three separate parts—702*a*, 702*b*, and 702*c*. However, in other embodiments, diffuser cap 702 can be made of more or fewer parts. Diffuser cap 702 may be coupled to heat sink using a snap fitting or other appropriate fitting. Diffuser cap 702 includes flat portion 704 to accommodate a cover, as shown in detail in FIG. 8.

Figure 8:
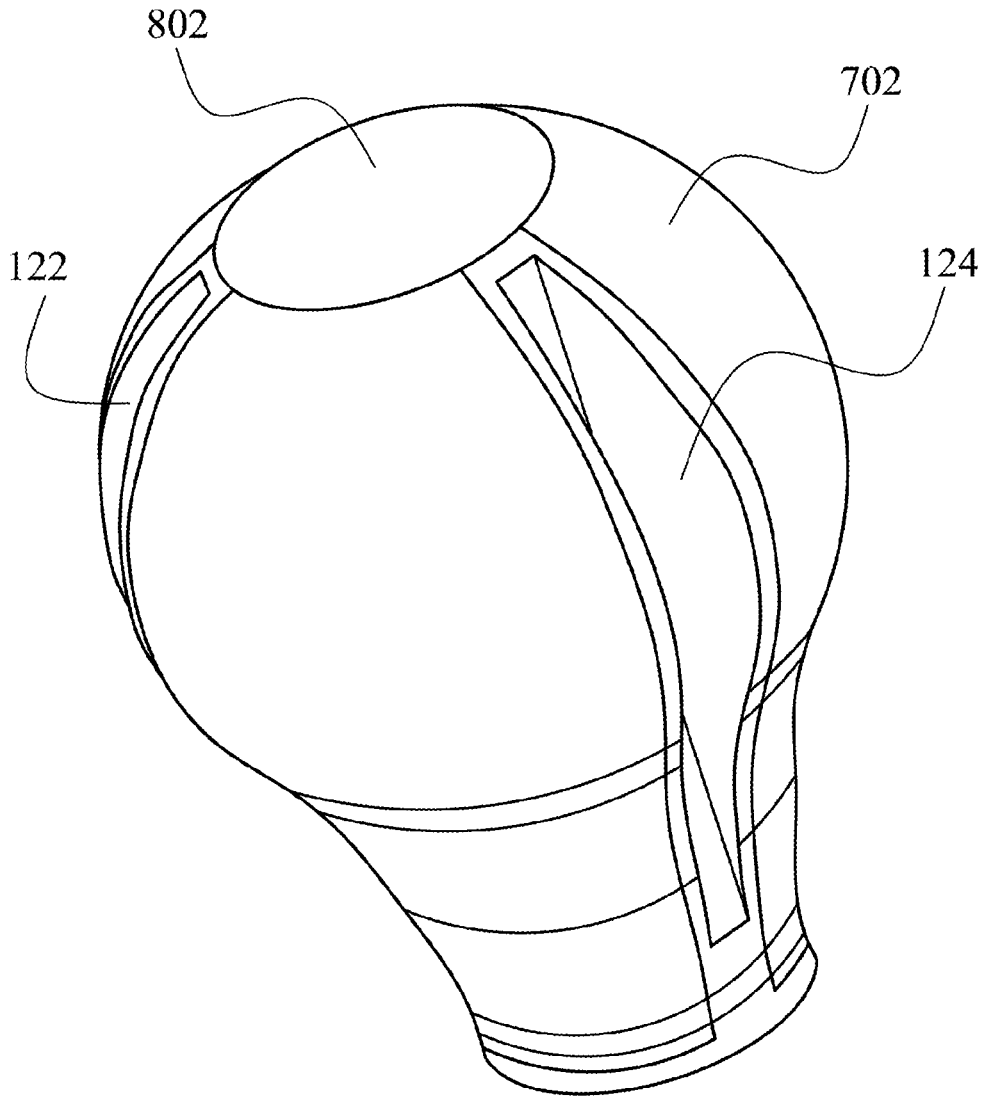

At FIG. 8, cover 802 is placed on the top of the A-lamp. Cover 802 covers the open end at the top 104 (FIG. 1) of the semi-enclosed space 202 (FIG. 2). Furthermore, cover 802 fits the top of diffuser cap 702 to make a snug fit. In one example, cover 802 snaps into diffuser cap 702, though other embodiments may user other techniques to couple cover 802 to the lamp assembly.

Cover 802 may be constructed of any of a variety of materials. In one example, cover 802 is made of PC plastic. In another example, cover 802 is made of acrylonitrile butadiene styrene (ABS) or other type of plastic. Other embodiments may include different materials for cover 802 and may make cover 802 transparent, translucent, or opaque.

In FIG. 8, the A-lamp shape becomes apparent, where the bottom is narrow, and the top is quasi-spherical, the bottom gradually transitioning to the wider top. A typical incandescent A-lamp includes a glass bulb with a continuous and smooth surface. By contrast, the surface of the A-lamp assembly of FIG. 8 is not continuous, but rather is broken by fins 122, 124, 126. Nevertheless, the general shape of an A-lamp is preserved and is quite recognizable. In fact, the A-lamp assembly can be gripped and screwed/unscrewed like a typical incandescent A-lamp. Moreover, despite the discontinuous outer surface of the A-lamp assembly, the light pattern emitted from the A-lamp assembly is perceived by a human user as being nearly as uniform as that of an incandescent A-lamp. Specifically, the diffuse characteristic of the emitted light (by virtue of diffuser cap 702) and the aggregate multi-directionality of facets 112, 114, 116 endows a uniformity to the light pattern.

Figure 9:
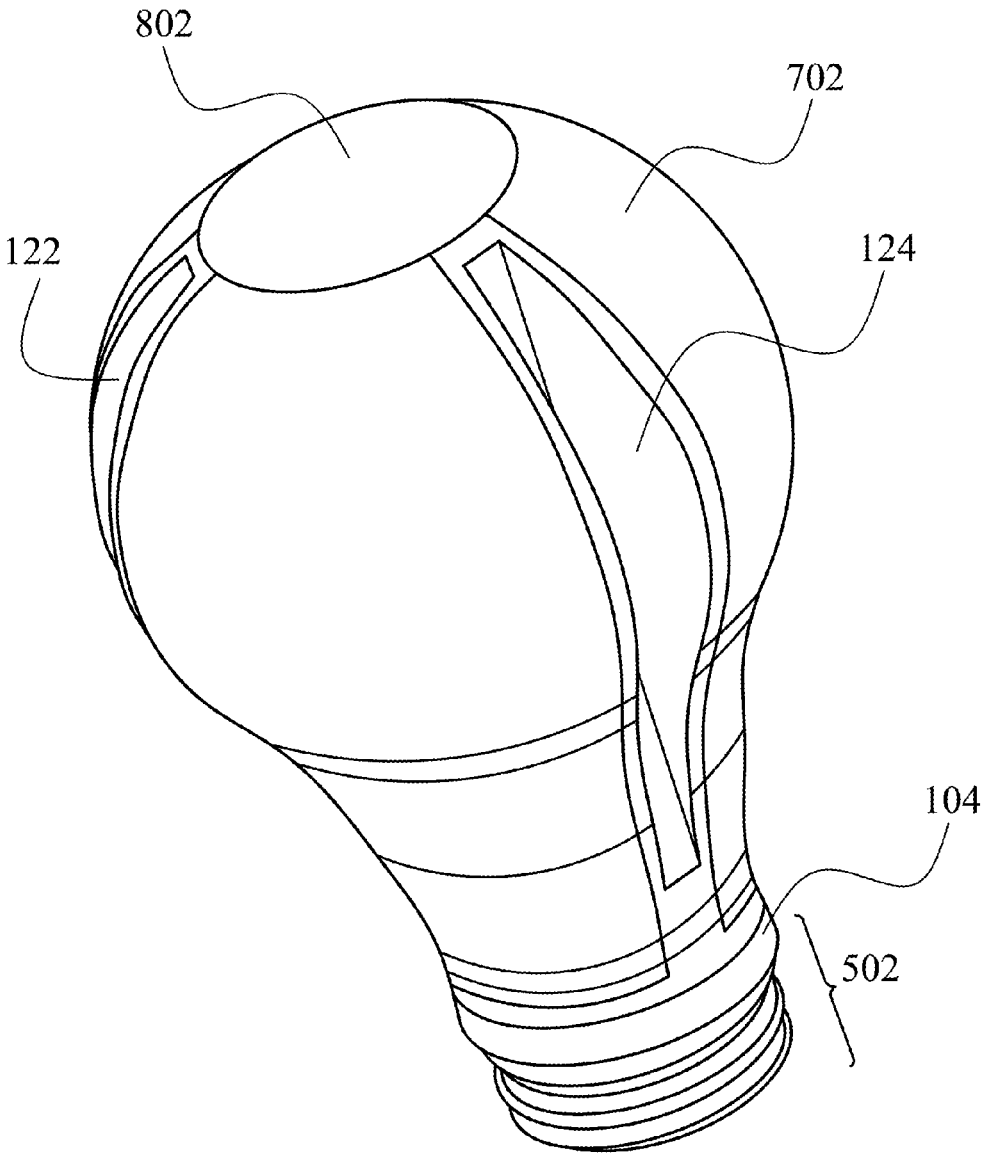

In FIG. 9, isolated cap 902 is installed on the A-lamp assembly. The isolated cap installs at the base 104 of heat sink 100. The purpose of isolated cap 902 is to provide mechanical support for the power connector shown in FIG. 10 while at the same time electrically isolating the heat sink 100 from the power connector. Isolated cap 902 may be installed in the assembly using any appropriate technique, such as a snap fitting, adhesive glue, and/or the like.

Isolated cap 902 may be constructed of any of a variety of materials. In one example, isolated cap 902 is made of PC plastic. In another example, isolated cap 902 is made of acrylonitrile butadiene styrene (ABS) or other type of plastic. Other embodiments may include different materials for cover 802 if such materials provide appropriate electrical isolation and mechanical support.

Figure 10:
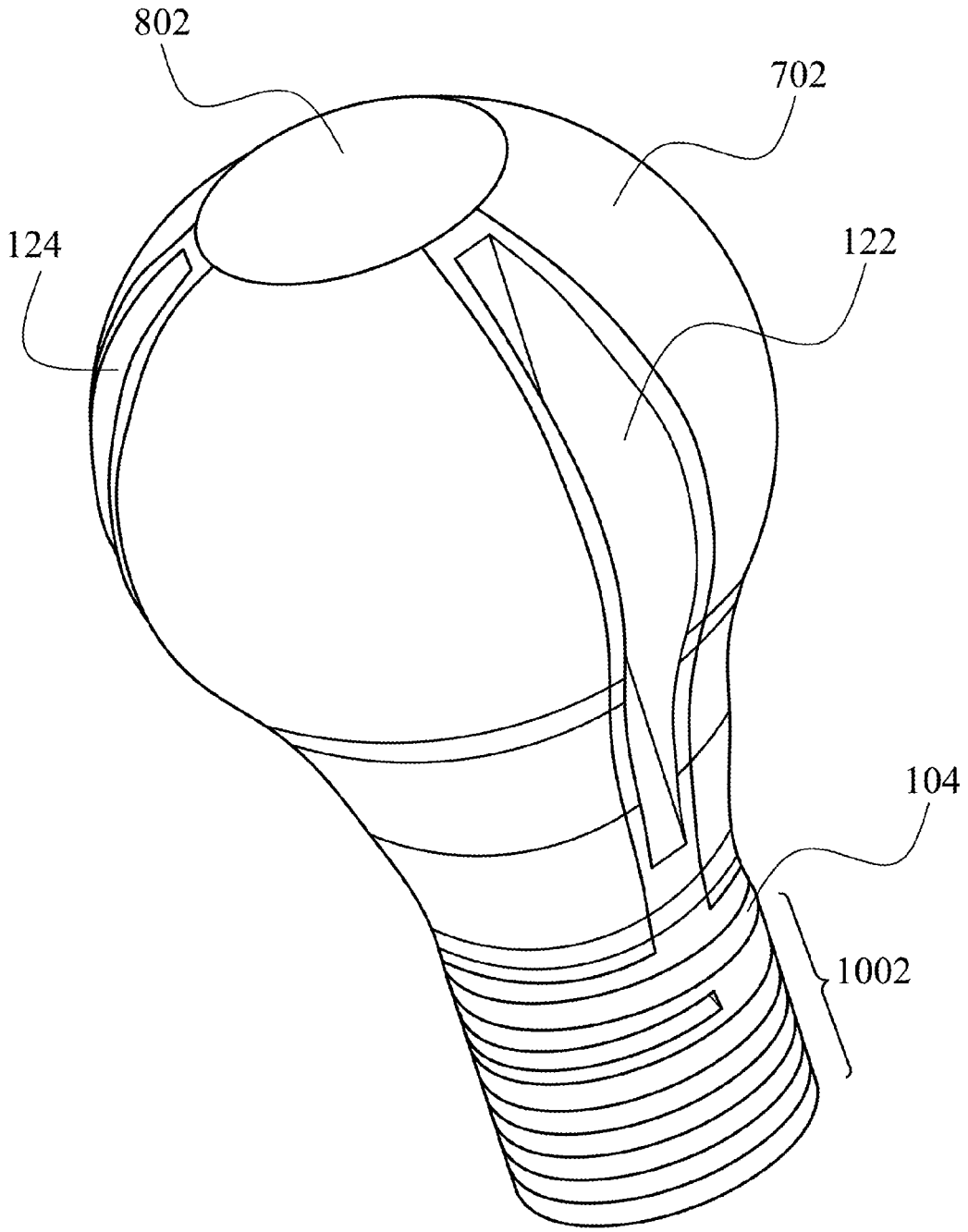

In FIG. 10, power connector 1002 is installed on isolated cap 902. Power connector 1002 interfaces with a power outlet to supply power to power converter module 502 (FIG. 5). Though not shown in FIG. 10, it is understood that power connector 1002 may be in electrical communication with power converter module 502 through any appropriate technique, including the use of soldered electrical wires.

In this example, power connector 1002 conforms to an Edison Screw shape, which is familiar to consumers as the type of connector that screws into a standard light socket. Edison Screws come in many different sizes, with the most familiar one in the United States market being the E27 (27 mm) fitting. The scope of embodiments is not limited to any particular configuration for power connector 1002. While some embodiments are made as Edison Screws, other embodiments may include bi-pin fittings (including twist-lock fittings), bayonet fittings, and the like. Power connector 1002 may be made of conductive metals with insulating materials to isolate the oppositely polarized contacts.

FIG. 10 shows the A-lamp assembly substantially complete. As shown, the A-lamp assembly is ready to be retrofitted into a standard light socket, such as in a table lamp. The power conversion module 502 (FIG. 5) converts the power received from the light socket to an acceptable DC power, and the arrays of LEDs produce a light pattern that is comparable to that of an incandescent A-lamp. Heat sink 100 (FIGS. 1-6) effectively manages the thermal performance of the A-lamp by absorbing heat from the arrays of LEDs and dissipating the heat to the surrounding atmosphere by virtue of fins 122, 124, 126.

Figure 11A:
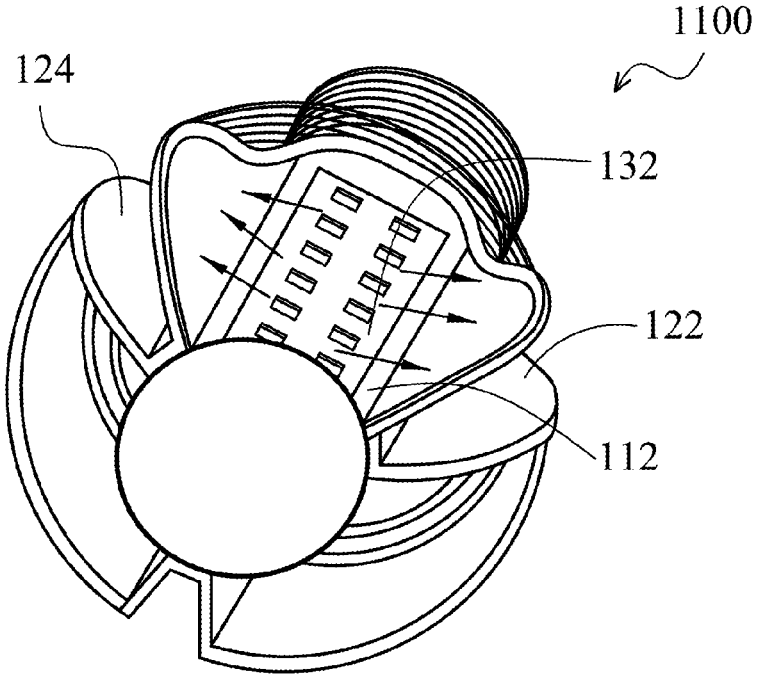
FIGS. 11A-11C are different views of an exemplary LED lamp in accordance with various aspects of the present disclosure to show how heat may be transferred and dissipated.
Figure 11B:
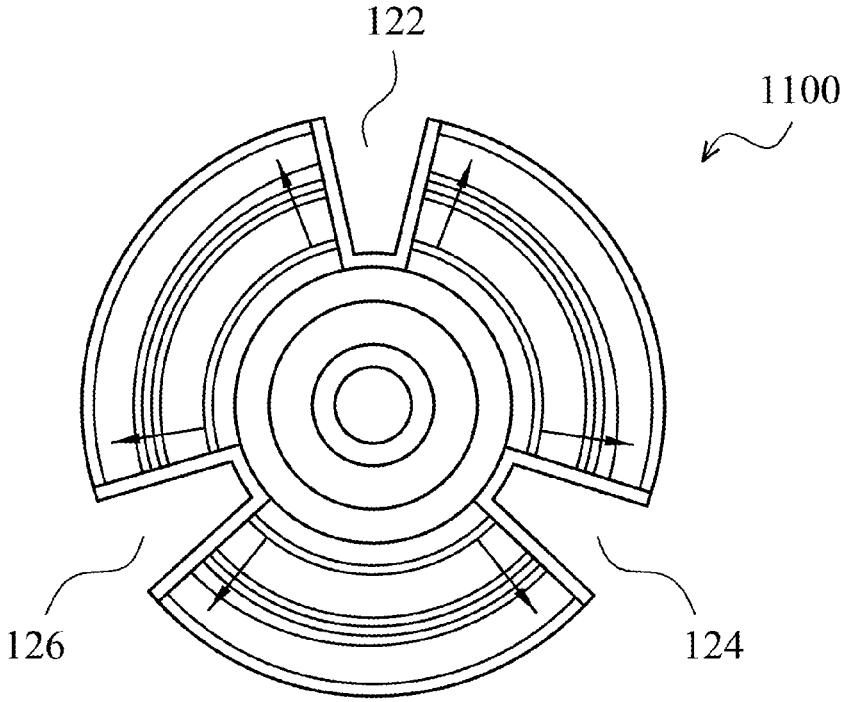
Figure 11C:
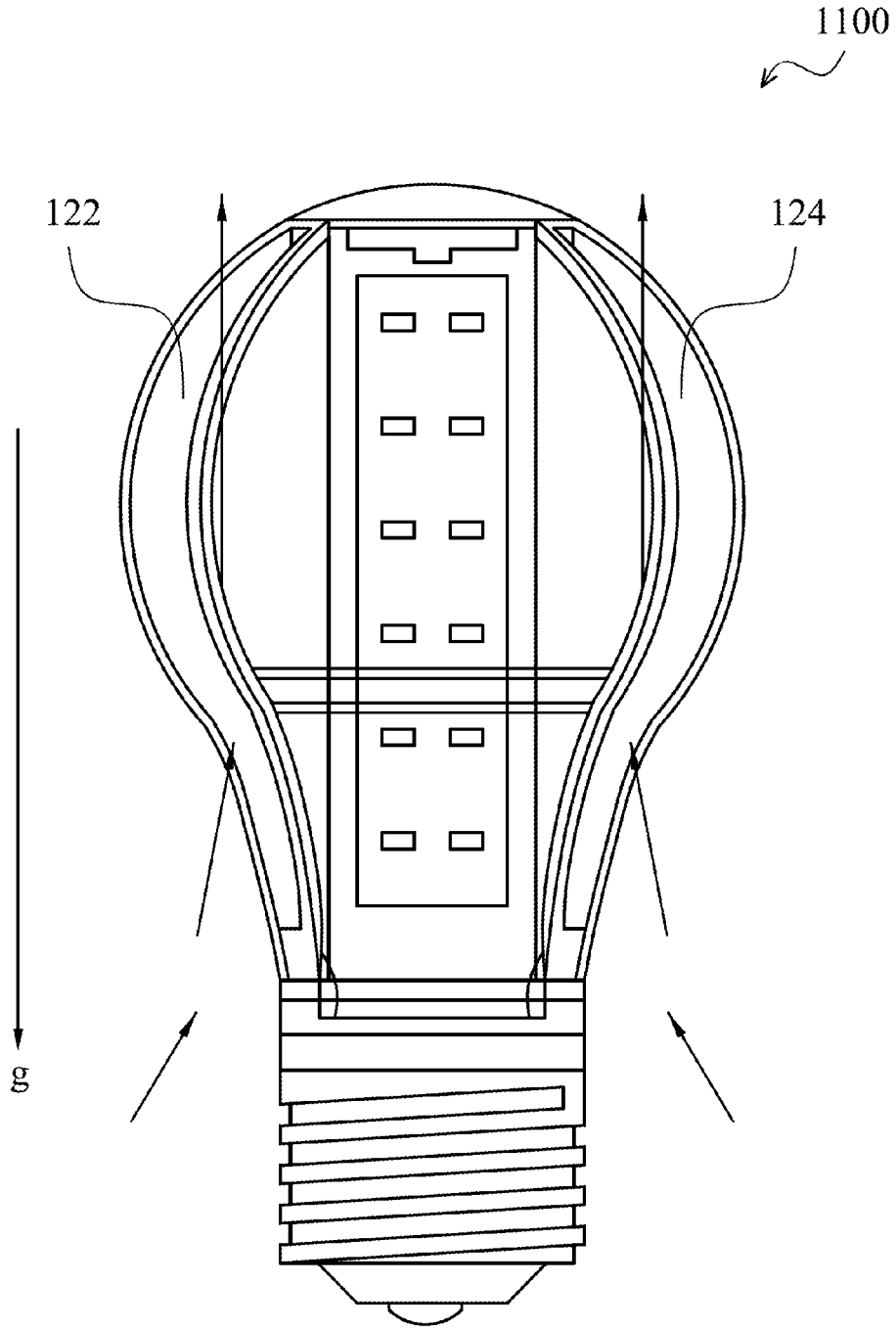

Heat dissipating properties are explained in more detail in FIGS. 11A-C. FIGS. 11A-C show exemplary paths of thermal spreading provided by exemplary A-lamp 1100. FIG. 11A provides a perspective view of A-lamp 1100; FIG. 11B provides a top-down view; FIG. 11C provides a side view.

FIG. 11A a uses arrows to show paths of heat dissipation from the arrays of LEDs. Using facet 112 and PCB 132 as an example, heat travels from the LEDs to PCB 132 to the heat sink 100, reaching fins 122 and 124.

FIG. 11B shows heat travelling outwardly from the facets (not shown) of heat sink 100 to fins 122, 124, 126. FIG. 11C shows exemplary airflow dissipating heat from fins 122, 124, 126. FIG. 11C shows a "g" with a downward arrow illustrating the force of gravity in one orientation, where warmer air rises. It is not required in various embodiments that the air is moving or that the air is ambient air; however, moving air will usually provide better cooling than still air or trapped air in some embodiments.

Figure 12A:
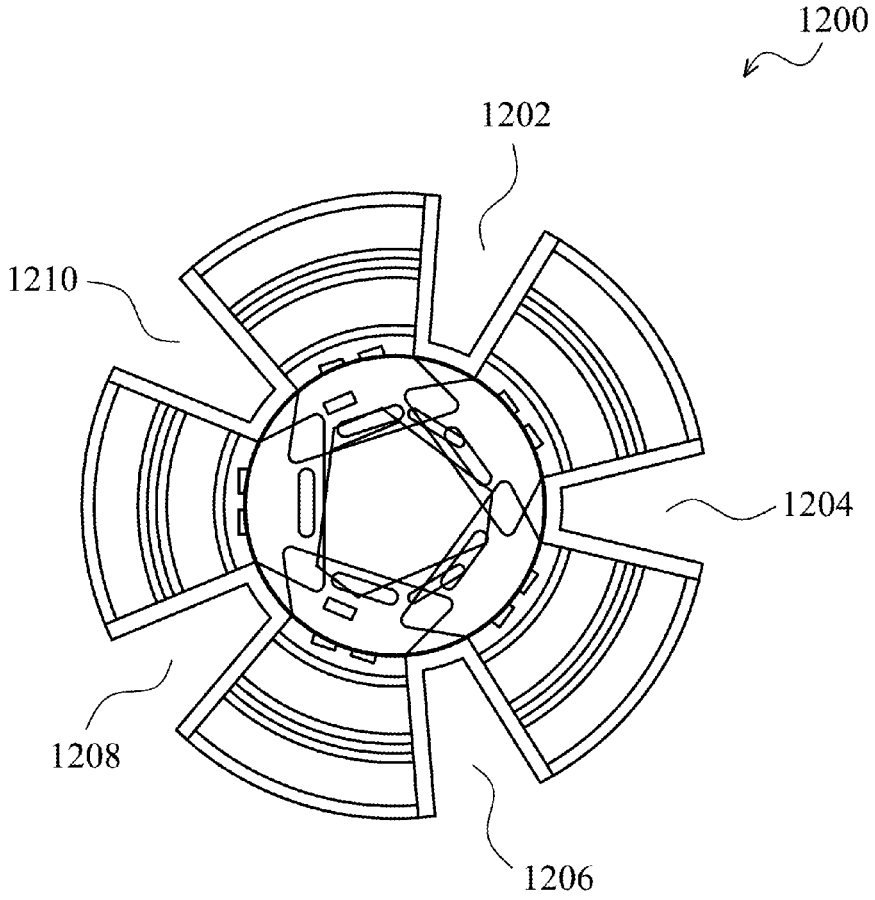
FIGS. 12A and B are illustrations of an alternative embodiment of an LED lamp according to various aspects of the present disclosure.
Figure 12B:
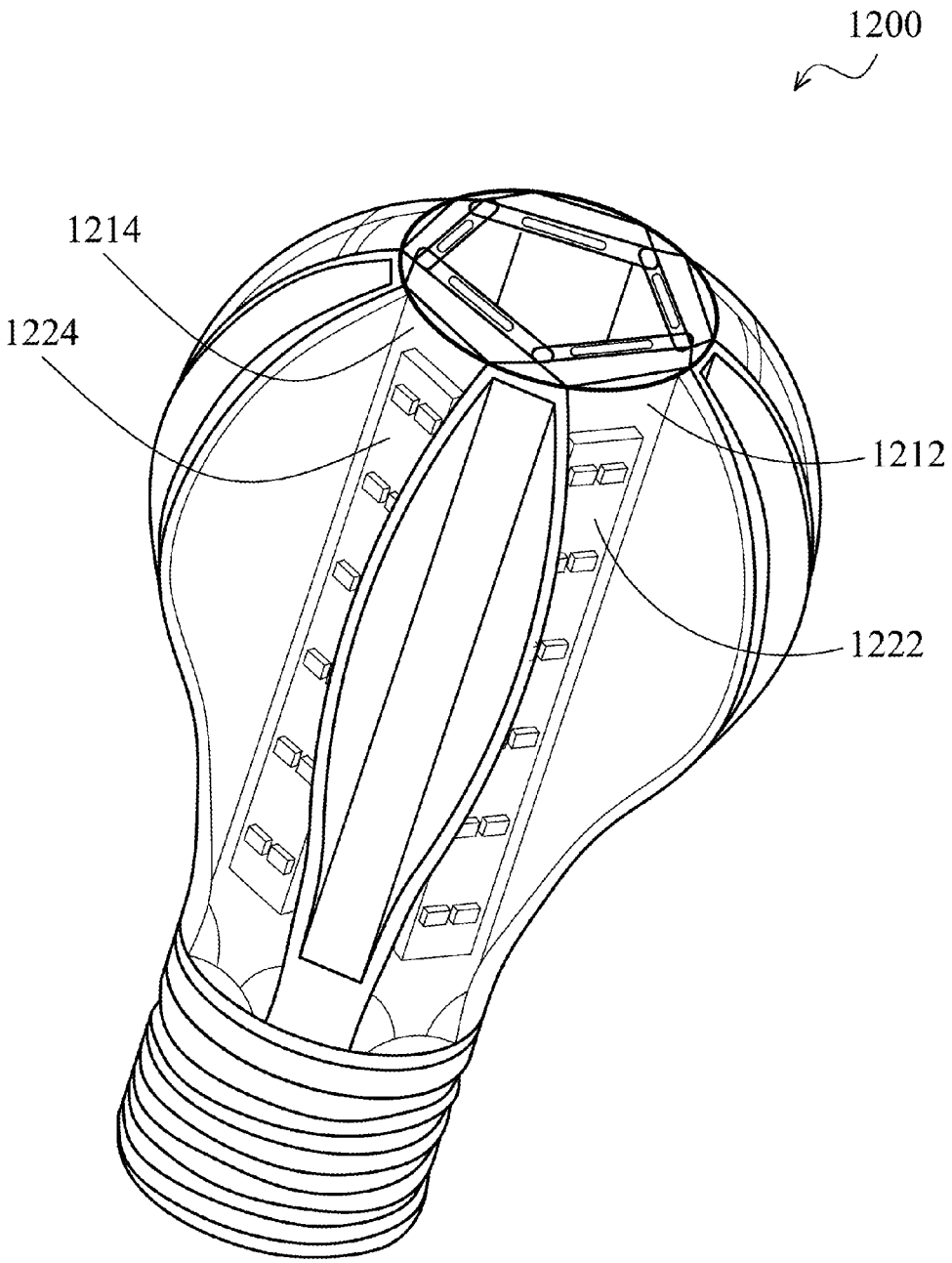

The embodiment of FIGS. 1-11 includes three facets and three fins, spaced apart by 120 degrees to provide a 360-degree pattern. Various embodiments may include different numbers of facets and fins to provide desirable lighting and thermal management characteristics. FIGS. 12A and B illustrate exemplary A-lamp 1200, adapted according to another embodiment. A-lamp 1200 includes five fins 1202, 1204, 1206, 1208, and 1210, each with double-fin substructures, as with the previously-described embodiment. The five facets are not shown together in the views of FIGS. 12A and B, but are exemplified by facets 1212, 1214. Facet 1212 includes PCB 1222, and facet 1214 includes PCB 1224, each with its own array of LEDs. The embodiment of FIGS. 12A, B has less surface area for its facets than does the embodiment of FIGS. 1-11. However, the embodiment of FIGS. 12A, B has more surface area exposed to air because it has five fins (1202, 1204, 1206, 1208, 1210) compared to three fins for the embodiment of FIGS. 1-11. The various embodiments are not limited to three or five facets/fins, but may include any appropriate number of facets/fins.

Figure 13:
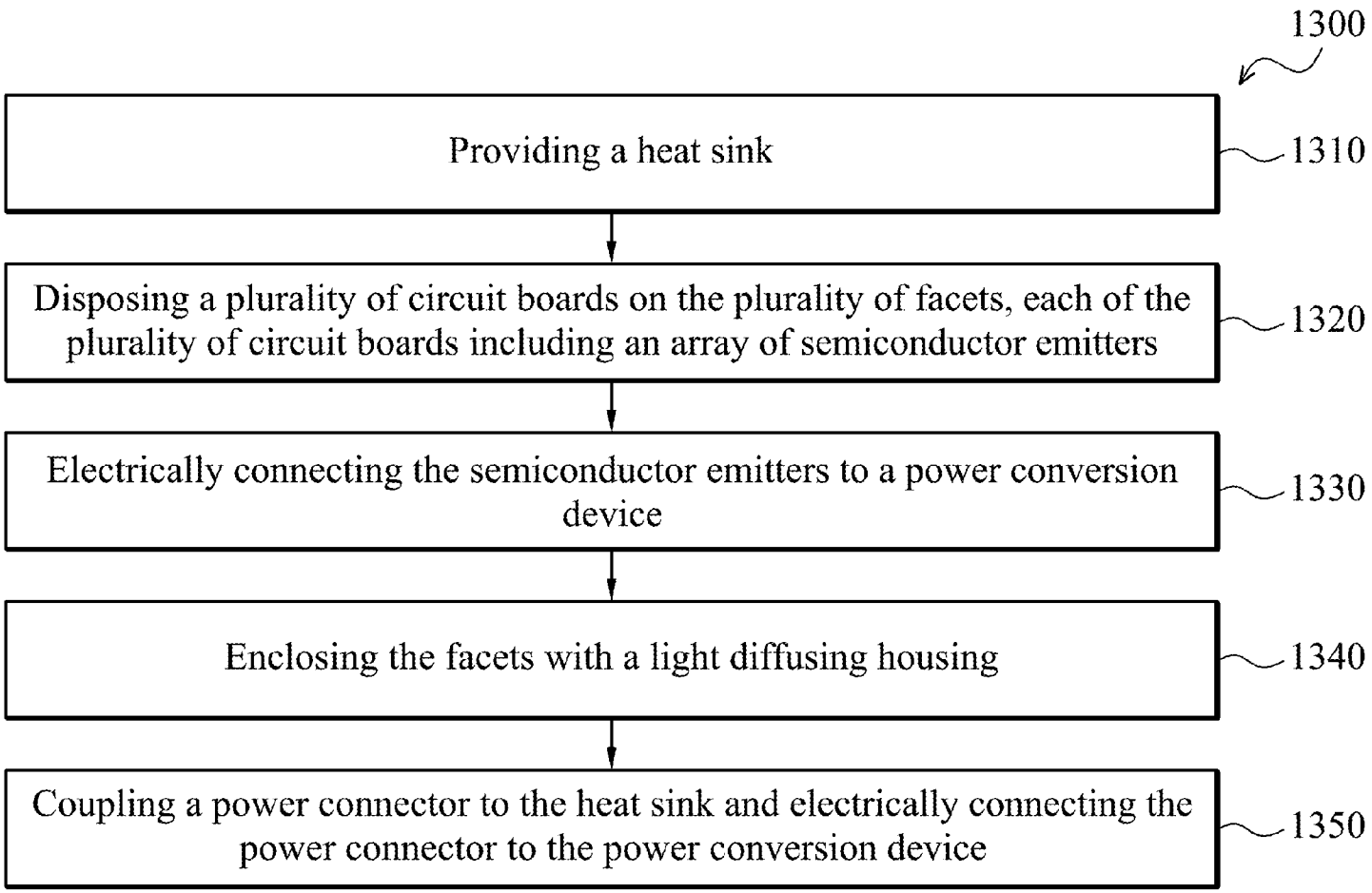
FIG. 13 is a flowchart illustrating a method for fabricating an LED lamp according to various aspects of the present disclosure.

FIG. 13 is an illustration of exemplary process 1300 for manufacturing LED lamps, such as those shown in FIGS. 1-12. Process 1300 may be performed by humans, machines, or both in or more assembly facilities. The lamps may conform to an A-lamp form factor or may be differently shaped.

In block 1310, a heat sink is provided. The heat sink may be configured similarly to heat sink 100 of FIG. 1, which has three facets and three fins, or may have different numbers of facets and fins.

In block 1320, a plurality of circuit boards are disposed on the plurality of facets. The circuit boards may include MCPCBs or other types of circuit boards. Each of the plurality of circuit boards has an array of semiconductor emitters thereon. Examples of circuit boards with semiconductor emitters are shown by example in FIGS. 1 and 12A, B.

In block 1330, the semiconductor emitters are electrically connected to a power conversion device. In some embodiments, block 1330 also includes mounting the power conversion device on the heat sink. An example power conversion device, its placement, and performance are shown and described with respect to FIGS. 5 and 6.

In block 1340, the facets are enclosed with a light diffusing housing. The light diffusing housing makes the light from the semiconductor emitters have a more uniform pattern and appear softer to the human eye. Example light diffusion housings are shown in FIGS. 7 and 13.

In block 1350, a power connector is coupled to the heat sink and is electrically connected to the power conversion device. In one example, the power connector is electrically isolated from the heat sink by an isolated cap. An example power connector is shown in FIGS. 10 and 11 as an E27 connector, though other embodiments may use different power connectors.

The scope of embodiments is not limited to the discrete steps shown in FIG. 13. Other embodiments may add, omit, rearrange, or modify actions. For instance, in other embodiments the resultant semiconductor emitter lamp may conform to a different shape or have more or fewer facets/fins.

Various embodiments may include one or more advantages over some conventional LED lamps. For instance, in some embodiments the LED arrays face multiple different directions in the same lamp and are covered by a diffusion cap, thereby providing a substantially uniform lighting pattern. Such lighting pattern may be seen as substantially similar to that produced by a comparable incandescent lamp. Furthermore, the facet/fin design of the example embodiments may help to effectively transfer heat from the LED arrays to the surrounding air without diminishing the substantially uniform light pattern.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A lighting module comprising a heat sink, comprising a plurality of facets surrounding a central axis, the facts collectively defining a semi-enclosed space; and a plurality of fins disposed between the adjacent facets, wherein each of the fins is essentially consisted of two fin sub-structures and protrudes outwardly away from the central axis, and wherein the bottoms of the two fin sub-structures are connected to each other to form a groove parallel to the central axis to form a space providing for airflow and contacting with ambient air, and wherein for the two fin sub-structures, each fin increases in distance from each other as they extend from the central axis; and a plurality of light-emitting diodes (LEDs) disposed over each of the facets, wherein the LEDs are each configured to project light outwardly away from the central axis.

2. The lighting module of claim 1, further comprising a plurality of circuit boards that are each mounted on a different one of the facets, wherein each circuit board has one or more of the LEDs disposed on it.

3. The lighting module of claim 1, further comprising a plurality of diffuser caps each disposed over a different group of the LEDs, wherein the diffuser caps are not disposed over the airflow paths defined by the fins.

4. The lighting module of claim 3, wherein the fins and the diffuser caps each have a curved sectional-view profile in a direction parallel to the central axis.

5. The lighting module of claim 4, wherein the curved sectional-view profile conforms to a sectional-view profile of an A-lamp.

6. The lighting module of claim 1, wherein the semi-enclosed space defined by the facets has a triangular top view profile or a polygonal top view profile.

7. The lighting module of claim 1, wherein the semi-enclose space is filled with an electrically-isolating gel.

8. The lighting module of claim 1, further comprising a power-conversion module disposed within the semi-enclosed space.

9. The lighting module of claim 1, further comprising a plurality of diffuser caps, wherein each of the plurality of facets is disposed underneath a different one of the diffuser caps.

10. The lighting module of claim 1, wherein the fins each has a non-flat contour.

11. The lighting module of claim 1, wherein the heat sink including the plurality of facets and the plurality of fins is a one-piece structure.

12. The lighting module of claim 1, wherein the profile of one of the fins is gradually narrow near the base and the top of the lighting module.

13. A lighting module, comprising:

a heat sink that includes a plurality of facets and a plurality of fins, wherein each facet faces a different direction and is directly connected to two fins, and wherein each fin is essentially consisting of two outwardly-protruding fin sub-structures, and wherein the bottoms of the two fin sub-structures are connected to each other to form a groove extending in a direction which is parallel to a central axis and along the fin sub-structure to form a space providing for airflow and contacting with ambient air, and wherein the two fin sub-structures of each fin increase in distance from each other as they extend from the central axis; and a plurality of light-emitting diodes (LEDs) that are disposed over the facets, wherein the LEDs are each configured project light outwardly away from the central axis.

14. The lighting module of claim 13, wherein the fine sub-structure has a curved side-view shape, and the curved side-view shape conforms to a side-view shape of an A-lamp.

15. The lighting module of claim 13, further comprising: a plurality of diffuser caps that are each disposed over a respective subset of the LEDs, wherein each diffuser cap is coupled to a different subset of the fins.

16. The lighting module of claim 13, further comprising: a plurality of circuit boards on which the LEDs are disposed, wherein each circuit board is disposed on a different one of the facets.

17. The lighting module of claim 13, wherein:

the facets are circumferentially disposed around an elongate axis;

the fins each protrude outwardly away from the elongate axis; and the LEDs are each configured to project light away from the elongate axis.

18. The lighting module of claim 17, wherein the facets collectively define an semi-enclosed space through which the elongate axis extends, the semi-enclosed space having a triangular top view profile or a polygonal top view profile.

19. The lighting module of claim 13, wherein the heat sink including the plurality of facets and the plurality of fins is a one-piece structure.

20. The lighting module of claim 13, wherein the profile of one of the fins is gradually narrow near the base and the top of the lighting module.

* * * * *